US006548427B1

(12) United States Patent
Shannon et al.

(10) Patent No.: US 6,548,427 B1
(45) Date of Patent: Apr. 15, 2003

(54) SANITARY TISSUE PRODUCTS WITH IMPROVED FLUSHABILITY

(75) Inventors: Thomas G. Shannon, Neenah, WI (US); Michael J. Smith, Neenah, WI (US); Patrick P. Chen, Appleton, WI (US); Graciela Jimenez, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 175 days.

(21) Appl. No.: 09/718,813

(22) Filed: Nov. 22, 2000

Related U.S. Application Data

(60) Provisional application No. 60/167,435, filed on Nov. 23, 1999.

(51) Int. Cl.[7] ..... B32B 5/02; B32B 27/04; D21H 17/64

(52) U.S. Cl. ..... 442/118; 442/153; 442/154; 428/313.3; 428/311.31; 428/402.2; 162/90; 162/168.3; 162/189; 162/191

(58) Field of Search ..... 428/313.3, 402.2, 428/311.31; 442/118, 153, 154; 162/90, 168.3, 159, 191

(56) References Cited

U.S. PATENT DOCUMENTS

| | | | | |
|---|---|---|---|---|
| 3,556,932 A | | 1/1971 | Coscia et al. | 162/166 |
| 4,605,702 A | | 8/1986 | Guerro et al. | 525/154 |
| 4,986,882 A | * | 1/1991 | Mackey et al. | 162/109 |
| 5,760,212 A | | 6/1998 | Smith | 536/123.1 |
| 5,830,317 A | | 11/1998 | Vinson et al. | 162/125 |
| 5,935,383 A | * | 8/1999 | Sun et al. | 162/158 |
| 5,993,602 A | | 11/1999 | Smith et al. | 162/112 |

FOREIGN PATENT DOCUMENTS

| | | |
|---|---|---|
| EP | 0408128 A3 | 7/1990 |
| EP | 0768425 A2 | 9/1996 |
| EP | 0802282 A1 | 11/1996 |
| WO | WO98/24974 | 11/1997 |

* cited by examiner

*Primary Examiner*—Terrel Morris
*Assistant Examiner*—John J. Guarriello
(74) *Attorney, Agent, or Firm*—Nelson Mullins Riley & Scarborough

(57) ABSTRACT

The present invention is generally directed to a tissue product with improved flushability. Specifically, the incorporation of both a temporary wet strength agent and an alkaline reagent into the tissue product results in the tissue product having high initial wet tensile strength and a high rate of wet tensile loss. The high rate of wet tensile loss is caused by the high pH of the alkaline reagent that is incorporated during the dry end of a tissue manufacturing process. The temporary wet strength agent is added in the wet end of a tissue manufacturing process. In certain embodiments of the present invention, glyoxylated polyacrylamide may be used as the temporary wet strength agent, while the alkaline reagent may be in dry form or may be encapsulated.

10 Claims, 1 Drawing Sheet

SANITARY TISSUE PRODUCTS WITH IMPROVED FLUSHABILITY

The present invention is based on provisional patent application Ser. No. 60/167,435 filed Nov. 23, 1999, and priority is hereby claimed therefrom.

FIELD OF THE INVENTION

The present invention is generally directed to improving the flushability of a tissue product by the addition of a temporary wet strength agent and a bond degrading agent. More particularly, the present invention is directed to tissue products with improved flushability wherein a temporary wet strength agent is added to the tissue products in the wet end and an alkaline reagent is incorporated into the tissue products in the dry end.

BACKGROUND OF THE INVENTION

Sanitary tissue products often comprise temporary wet strength agents to enhance product performance. Improved wet strength attributes are achieved as a result of the formation of covalent bonds between the cellulosic fibers of the tissue product and the wet strength agent. Such covalent bonding is typically achieved through the formation of acetal linkages between a polymeric agent such as glyoxylated polyacrylamide and the cellulosic fibers.

However, it is essential that such covalent wet strength bonds be transient in nature for sanitary bath tissue. If the covalent bonds are transient in nature, the tissue products break up more easily in water and hence exhibit improved flushability. Such tissue products with improved flushability are less injurious to septic systems.

Specifically, acetal bond formation is reversible, thus making glyoxylated polyacrylamide a good temporary wet strength agent. The covalent bonds formed are transient in nature, and thus tissue products with glyoxylated polyacrylamide incorporated therein exhibit increased flushability.

It is difficult to design a tissue product having both the desired level of wet strength to facilitate high tissue performance and the desired levels of flushability and degradability. The factors to be weighed in designing such a product include initial wet tensile strength, the rate of wet tensile loss, and the final wet tensile strength. The optimal tissue product has a high initial wet tensile strength which degrades rapidly in water to a low final wet tensile strength to aid in flushability.

A prior art tissue product made by the assignee of the present invention is known wherein baking soda has been incorporated to improve the tissue's water break up. However, the temporary wet strength agent used for this tissue product was not glyoxylated polyacrylamide. Glyoxylated polyacrylamide specifically causes the formation of hemi-acetyl bonds that degrade much faster in a basic medium.

Thus, a need currently exists for a tissue product having high initial wet tensile strength which degrades rapidly in water to a low final wet tensile strength for improved flushability. More specifically, a need exists for a tissue product wherein an alkaline reagent has been added to the tissue product in the dry end after a temporary wet strength agent like glyoxylated polyacrylamide has been added in the wet end.

SUMMARY AND OBJECTS OF THE INVENTION

It is an object of the present invention to provide tissue products with improved flushability wherein a temporary wet strength agent has been added to the tissue product in the wet end and an alkaline reagent has been added to the tissue in the dry end.

It is another object of the present invention to add an alkaline reagent to a tissue product in a manner so that the rate of degradation is enhanced while the initial wet tensile strength of the tissue is not negatively affected.

The above objects and, perhaps, other objects are accomplished by incorporating a temporary wet strength agent such as glyoxylated polyacrylamide into a tissue product during the wet end of the tissue manufacturing process. Subsequently, the addition of an alkaline reagent in the dry end increases the pH of the tissue product and thus leads to improved degradation of the acetal bonds between the temporary wet strength agent and the cellulosic fibers of the tissue product. In certain embodiments, the amount of the alkaline reagent added may be from about 0.1 to about 5% based on the weight of the dry web of the tissue product.

These and other features, aspects and advantages of the present invention will become better understood with reference to the following description and appended claims. The accompanying drawing, which is incorporated in and constitutes a part of this specification, illustrates an embodiment of the invention and, together with the description, serves to explain the principles of the invention.

BRIEF DESCRIPTION OF THE DRAWING

A full and enabling disclosure of the present invention, including the best mode thereof, to one of ordinary skill in the art, is set forth more particularly in the remainder of the specification, including reference to the accompanying drawing, in which.

DETAILED DESCRIPTION OF PREFERRED EMBODIMENTS

Figure 1:
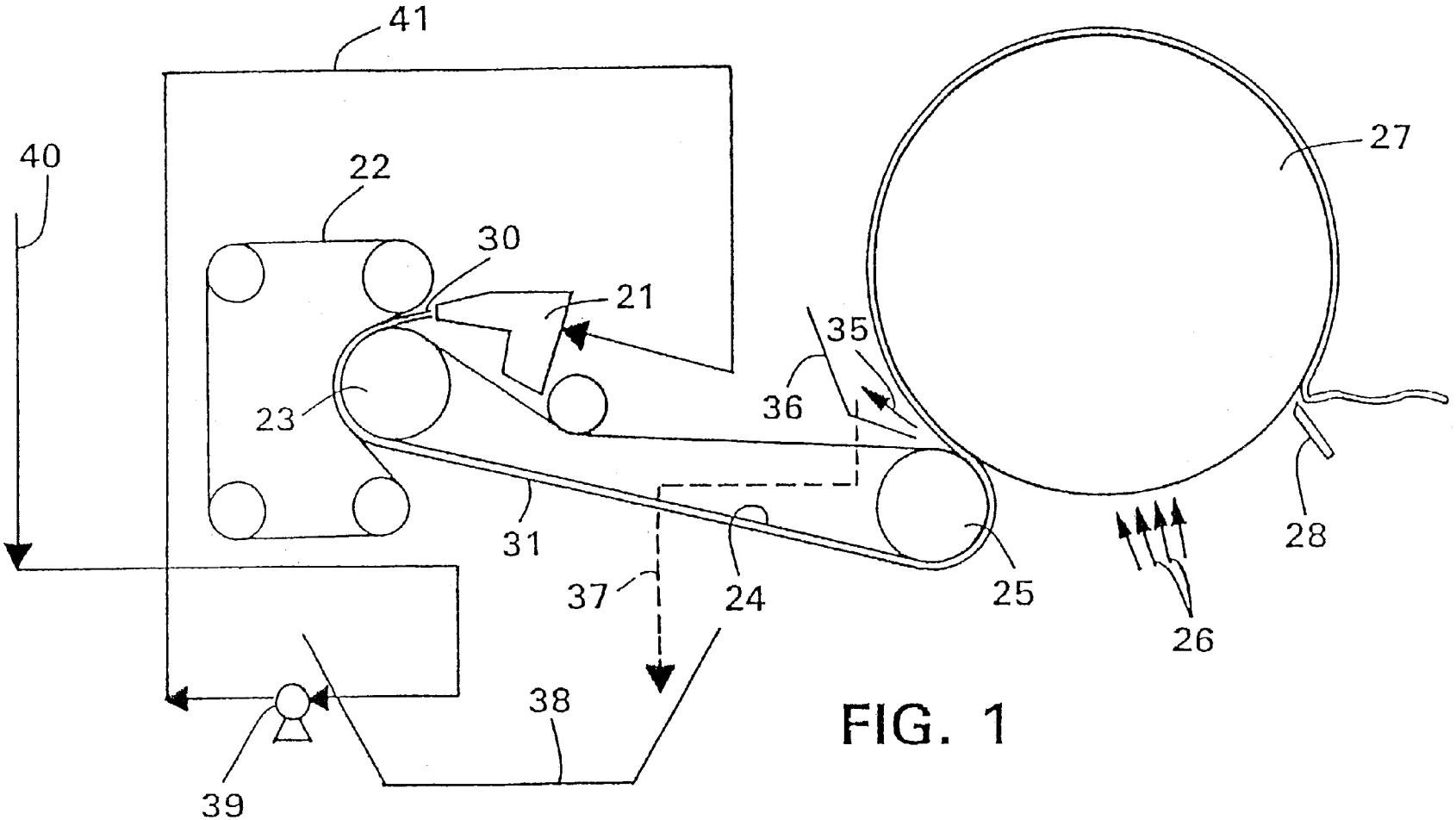
FIG. 1 is a schematic flow diagram of a conventional wet-pressed tissue making process useful in the practice of this invention.

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment.

Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

The process of the present invention is directed to the addition of a temporary wet strength agent, such as glyoxylated polyacrylamide, to a tissue product during the wet end of a tissue manufacturing process and the subsequent addition of an alkaline reagent to the tissue product during the dry end of the manufacturing process. In designing the inventive tissue products, it has been discovered that acetal bond degradation is enhanced by high pH or alkaline conditions. The incorporation of an alkaline reagent into the tissue product results in the tissue product having enhanced degradation and therefore improved flushability. The alkaline reagent thus increases the flushability of the tissue because the basic, high-pH additive increases the rate of the degradation of the acetal bonds formed between the temporary wet strength agent and the cellulosic fibers of the tissue. While the alkaline reagent improves the flushability of the tissue product, it does not substantially affect the initial tensile strength of the tissue.

The addition of the temporary wet strength agents in the wet end and the addition of an alkaline agent in the dry-end of a tissue manufacturing process is effected by adding those materials at the wet and dry ends of the process of forming a tissue product web. Typically, tissue products are made according to widely known papermaking-type processes. For example, U.S. Pat. No. 5,129,988 to Farrington, Jr.; U.S. Pat. No. 5,772,845 to Farrington, Jr. et al.; and U.S. Pat. No. 5,494,554 to Edwards et al. disclose various tissue-making methods and methods for forming multi-layered paper webs. Such patents are incorporated herein in their entireties by reference thereto.

FIG. 1 is a schematic flow diagram of a conventional wet-pressed tissue making process useful in the practice of this invention, although other tissue making processes can also benefit from the method of this invention, such as through-air-drying or other non-compressive tissue making processes. The specific formation mode illustrated in FIG. 1 is commonly referred to as a crescent former, although many other formers well known in the papermaking art can also be used. Shown is a headbox 21, a forming fabric 22, a forming roll 23, a paper making felt 24, a press roll 25, a spray boom 26, a Yankee dryer 27, and a creping blade 28. Also shown, but not numbered, are various idler or tension rolls used for defining the fabric runs in the schematic diagram, which may differ in practice. As shown, the headbox 21 continuously deposits a stock jet 30 between the forming fabric 22 and felt 24, which is partially wrapped around the forming roll 23. Water is removed from the aqueous stock suspension through the forming fabric by centrifugal force as the newly-formed web traverses the arc of the forming roll. As the forming fabric and felt separate, the set web 31 stays with the felt and is transported to the Yankee dryer 27.

At the Yankee dryer, creping chemicals may be continuously applied in the form of an aqueous solution to the surface of the Yankee dryer on top of the residual adhesive remaining after creping. The creping chemicals can include one or more dry strength agents. The solution is applied by any conventional means, such as a spray boom 26 which evenly sprays the surface of the dryer with the creping adhesive solution. The point of application on the surface of the dryer is immediately following the creping doctor blade 28, permitting sufficient time for the spreading and drying of the film of fresh adhesive before contacting the web in the press roll nip.

The wet web 31 is applied to the surface of the dryer by means of the press roll or pressure roll 25 with an application force typically of about 200 pounds per square inch (psi). The incoming web is nominally at about 10% consistency (range from about 8 to about 20%) at the time it reaches the press roll. Following the pressing and dewatering step, the consistency of the web is at or above about 30%. The side of the web in contact with the surface of the Yankee dryer is referred to herein as the "dryer side" of the web. The opposite side of the web is referred to as the "air side" of the web. Sufficient Yankee dryer steam power and hood drying capability are applied to the web to reach a final moisture content of about 2.5% or less.

Also illustrated in FIG. 1 is the white water recycle system. At the press roll nip, white water effluent 35 expressed from the wet web is collected in catch pan 36. Because of the presence of a substantial amount of water in the pressure roll nip, some of the dry strength agent is transferred from the surface of the Yankee into the white water, which also contains fines. The collected white water 37 drains into wire pit 38. Thick stock 40 having a consistency of about 2 percent is diluted with white water at the fan pump 39 to a consistency of about 0.1 percent. The diluted stock 41 is subsequently injected into the headbox 21 to form the wet web.

The temporary wet strength agents of the present invention may be added anywhere in the wet end of the tissue making process. For example, the pigments may be added to the headbox 21, prior to headbox 21 in a separate apparatus that then flows the pigments into contact with the pulp furnish (sometimes referred to as stock suspension) in the headbox 21, or after the headbox 21 as a direct additive to the pulp furnish being carried between forming fabric 22 and felt 24.

A necessary condition of the process of the present invention is that the alkaline reagent be added to the tissue product or the web in a manner which avoids increasing the pH of the wet end of the tissue manufacturing process. The alkaline additive is thus incorporated into the tissue after the tissue is dried. If the alkaline reagent was added in the wet end or in an aqueous form, the debonding process (of the acetal bonds between the temporary wet strength agent and the cellulosic fibers) would commence during tissue manufacture rather than during tissue disposal. Thus, the alkaline agents are added after the aforesaid wet-end process stages and during the "dry-end" of the process. This would include any point in the process after the web has been dried sufficiently to remove water that might begin to cause disintegration of the web in the presence of the alkaline agent.

Papermaking fibers for making the tissue product webs of this invention include any natural or synthetic fibers suitable for the end use products listed above including, but not limited to: nonwoody fibers, such as abaca, sabai grass, milkweed floss fibers, pineapple leaf fibers; softwood fibers, such as northern and southern softwood kraft fibers; hardwood fibers, such as eucalyptus, maple, birch, aspen, or the like. In addition, furnishes including recycled fibers may also be utilized. In making the tissue products, the fibers are formed into a pulp furnish by known pulp stock formation processes.

Softening agents, sometimes referred to as debonders, can be added to the tissue making process to enhance the softness of the tissue product. Such softening agents can be incorporated with the fibers before, during or after dispersing the fibers in the furnish. Such agents can also be sprayed or printed onto the web after formation, while wet, or added to the wet end of the tissue machine prior to formation. Suitable softening agents include, without limitation, fatty acids, waxes, quaternary ammonium salts, dimethyl dihydrogenated tallow ammonium chloride, quaternary ammonium methyl sulfate, carboxylated polyethylene, cocamide diethanol amine, coco betane, sodium lauryl sarcosinate, partly ethoxylated quaternary ammonium salt, distearyl dimethyl ammonium chloride, polysiloxanes and the like. Examples of suitable commercially available chemical softening agents include, without limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2HT-75 (di(hydrogenated tallow) dimethyl ammonium chloride) manufactured by Akzo Chemical Company. Suitable amounts of softening agents will vary greatly with the species of pulp selected and the desired characteristics of the resulting tissue product. Such amounts can be, without limitation, from about 0.05 to about 1 weight percent based on the weight of fiber, more specifically from about 0.25 to about 0.75 weight percent, and still more specifically about 0.5 weight percent.

In certain embodiments of the present invention, glyoxylated polyacrylamide is used as the temporary wet strength agent that is incorporated into the tissue product at the wet end of the tissue manufacturing process. Specifically, Parez 631 NC from Cytec and Hercobond 1366 are appropriate sources of the glyoxylated polyacrylamide. As mentioned before, the addition of glyoxylated polyacrylamide to a tissue product results in the formation of acetal bonds between the wet strength agent itself and the cellulosic fibers of the tissue. These bonds impart temporary wet strength to a tissue product, thus increasing the performance level of the tissue product in normal applications.

In certain embodiments, the alkaline reagent may be in the form of high-pressure atomized particulates that are able to embed particles into a tissue. In other embodiments, water-activatable microspheres are filled with an alkaline reagent and then applied to the tissue product as either a lotion add-on, a spray add-on, or a printed add-on, for instance a rotogravure printed add-on. The microspheres disintegrate or disperse upon sufficient contact with water and allow the alkaline reagent to degrade the tissue. In these and other embodiments where the alkaline reagent is encapsulated or otherwise retained in combination with another material until its water-induced release, the release of the alkaline reagent may be controlled so that certain amounts of reagent are dispersed over a specified time period (in other words, the alkaline reagent is time-released).

The alkaline reagents to be used in the process of the present invention must be dry or encapsulated reagents (thus, not aqueous reagent solutions) that are soluble in water. In certain embodiments, salts of weak acids may be used as the alkaline reagent to be incorporated during the dry end of the tissue manufacturing process. Such salts might include, but are not limited to, sodium acetate, sodium benzoate, sodium carbonate, sodium bicarbonate, calcium carbonate and calcium bicarbonate. Other various dry, solid forms of various alkaline materials could also be employed as the alkaline agent of the present invention.

In certain embodiments of the present invention, the alkaline reagent is added in an amount of from about 0.1 to about 5% based on the weight of the dry web of the tissue product.

EXAMPLES

The present invention may be understood by reference to the following Examples, without being limited thereto. In each Example, the water break-up test was utilized to determine the temporary CD wet tensile strength. This test simulates the turbulence typically observed in a toilet bowl while flushing.

The water break-up test is conducted by cutting the tissue sample into one or more squares measuring 4 inches by 4 inches to provide a two-ply test sample (one-ply for single-ply product forms). The sample is oven-cured for 4 minutes at 105° C. The flow from a water faucet is adjusted to a rate of 2000±50 milliliters per 10 seconds. The water temperature is maintained between 21° C. and 26.5° C. The test sample is placed near the bottom of a 16-ounce, wide-mouth pint jar. A cover with a 4 inch by 4 inch mesh screen (obtained from McMaster-Carr, Inc.) is screwed over the jar. The screened opening of the jar is centered under the stream of water at a distance of 15±0.125 inches from the faucet outlet for a total of 2 minutes. The jar is rotated as needed to avoid plugging the screen with the tissue. After two minutes, the jar is pulled from the stream of water and the cover is removed. Any debris sticking to the screen is ignored. The remains in the jar are allowed to settle and half of the contents (clear liquid only) are decanted off. The remaining contents are poured into another 16 oz wide mouth bottle (similar size) resting on a black surface. Viewed from the top, the jar with the test sample is compared to six standard photographs which are disclosed in U.S. Pat. No. 5,993,602 (see FIGS. 2–7), which is incorporated herein in its entirety by reference thereto, and assigned a "photo grade" value relative to the six standards. The photo grade standards range in value from "0" (total breakup) to "5" (virtually no breakup).

Example 1

A blended creped bath tissue product was prepared via conventional wet pressing techniques to act as a control (without having the dry-end added alkaline agent). The sheet had a basis weight of 8.5 lbs./2880 $ft^2$. Prior to forming, a temporary wet strength resin (Parez 631 NC) was added in-line to the thick stock just prior to the fan pump at an addition level of 1 pound per ton of total dry fiber. The sheet was then formed into a two-ply sanitary bath tissue product having a basis weight of 17 lbs./2880 $ft^2$. The two-ply basesheet was found to have a photo grade value of 1 after 2 minutes. Initial water break-up time was found to be 20 seconds.

Example 2

A portion of the two-ply product of Example 1 was then taken and, sodium bicarbonate was applied to the web via a dry spray. A vacuum box was attached to the opposite side of the sheet directly opposite the spray nozzles to assist in transfer of the sodium bicarbonate into the bulk of the tissue sheet. The total weight of sodium bicarbonate applied to the finished sheet was found to be 0.5% by weight of the total sheet. The treated two-ply basesheet was found to have a photo-grade value of 0 after 73 seconds and an initial water break-up time of 6 seconds.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims. Therefore, the spirit and scope of the appended claims should not be limited to the description of the preferred versions contained therein.

What is claimed is:

1. A tissue product comprising:

a web of fibers, said web having incorporated therein:

a temporary wet strength agent that forms hemi-acetal bonds with the fibers of said web to prevent immediate degradation of said web when said tissue product is contacted with water; and an alkaline agent for interacting with said web to enhance the degradation of said web when said tissue product is contacted with water, wherein the alkaline agent is embedded in the web as dry or encapsulated particles.

2. The tissue product of claim 1 wherein said temporary wet strength agent comprises a glyoxylated polyacrylamide.

3. The tissue product of claim 1 wherein said alkaline agent is attached to a material that allows the release of said alkaline agent when said tissue product is contacted with water.

4. The tissue product of claim 1 wherein said alkaline agent is encapsulated within a water-activatable material so that said alkaline agent can be released when said tissue product is contacted with water.

5. The tissue product of claim 4 wherein said water-activatable material comprises water activatable microspheres which are filled with the alkaline agent.

6. The tissue product of claim 1 wherein said alkaline agent is present in said web in an amount of from about 0.1% to about 5.0% based on the dry weight of said web.

7. A tissue product comprising:

a web of cellulosic fibers, said web having incorporated therein:

a temporary wet strength agent that forms hemi-acetal bonds with the cellulosic fibers of said web to prevent immediate degradation of said web when said tissue product is contacted with water; and an alkaline agent for interacting with said web to enhance the degradation of said web when said tissue product is contacted with water, said alkaline agent being present in said web in an amount of from about 0.1% to about 5.0%, wherein the alkaline agent is embedded in the web as dry or encapsulated particles.

8. The tissue product of claim 7 wherein said temporary wet strength agent comprises a glyoxylated polyacrylamide.

9. In a process for forming a tissue product from a fibrous web, the improvement comprising the addition to the wet end of the tissue product forming process of a temporary wet strength agent that forms hemi-acetal bonds with the fibrous web; and the addition to the dry-end of the tissue product forming process of a dry or encapsulated alkaline agent.

10. The process of claim 9 wherein said temporary wet strength agent is a glyoxylated polyacrylamide and said alkaline agent is added at an amount of from about 0.1% to about 5.0% by dry weight of the fibrous web.

* * * * *